US008779261B2

(12) United States Patent
Dunlop

(10) Patent No.: US 8,779,261 B2
(45) Date of Patent: Jul. 15, 2014

(54) CONVERTER FOR FRETTED INSTRUMENTS

(75) Inventor: Jim Dunlop, Benicia, CA (US)

(73) Assignee: Dunlop Manufacturing, Inc., Benicia, CA (US)

( * ) Notice: Subject to any disclaimer, the term of this patent is extended or adjusted under 35 U.S.C. 154(b) by 49 days.

(21) Appl. No.: 13/287,976

(22) Filed: Nov. 2, 2011

(65) Prior Publication Data

US 2012/0125175 A1 May 24, 2012

Related U.S. Application Data

(60) Provisional application No. 61/409,430, filed on Nov. 2, 2010.

(51) Int. Cl.
*G10D 3/00* (2006.01)

(52) U.S. Cl.
USPC ..... 84/318

(58) Field of Classification Search
USPC ..... 84/318; 85/312 R
See application file for complete search history.

(56) References Cited

U.S. PATENT DOCUMENTS 3,933,077 A * 1/1976 Dunlop ..... 84/318
5,284,077 A * 2/1994 Ellis ..... 84/318

* cited by examiner

*Primary Examiner* — Jianchun Qin
(74) *Attorney, Agent, or Firm* — Stuart J. West; Shaun Sluman; West & Associates

(57) ABSTRACT

A device for converting a conventional Spanish guitar into an instrument which can be played like a Hawaiian guitar and/or used to modify the tone, pitch, key, timber and/or chord of a stringed instrument by selectively engaging the strings of a stringed instrument and selectively raising and/or lowering such strings relative to a fret board.

10 Claims, 2 Drawing Sheets

-with grooves

CONVERTER FOR FRETTED INSTRUMENTS

CROSS-REFERENCE TO RELATED APPLICATIONS

This application claims the benefit of priority to prior filed U.S. Provisional Patent Application No. 61/409,430, filed Nov. 2, 2010, the complete contents of which is hereby incorporated herein by reference.

BACKGROUND

1. Field of the Invention

The present invention related generally to clamping devices and more specifically to capo-type devices for use with fretted instruments.

2. Background

Generally, on stringed instruments a plurality of strings extend in parallel juxtaposition along the upper surface of an elongated neck. These strings are plucked by the player with the fingers of one of his hands, and the different notes are established by pressure of the finger tips of his other hand against the strings at different points longitudinally thereof. There are different types of guitars, but in the conventional type the upper surface of the neck is provided with a plurality of frets that extend transversely across the neck of the guitar and which are spaced from each other in a direction longitudinally of the neck. The strings in such guitars are arranged to extend slightly above these frets and the frets assist the player in locating the proper place for his fingers for establishing a certain note, which he does when he presses his finger or fingers against selected frets or, more specifically, against the upper surface of the neck of the guitar at a point slightly behind a selected fret (i.e., towards the "headstock" of the guitar). Another type of guitar is the Hawaiian guitar, which is similar to a steel guitar. These guitars differ from the conventional guitars in that the strings are positioned at such a height above the neck of the guitar that they cannot conveniently be brought into contact with the neck of the guitar by finger pressure on the player's part. Due to this difference, the player can slide an implement know as a "steel" longitudinally along the strings during play producing a peculiar "sobbing" sound effect that is typical for Hawaiian-type music.

Typically, a player wishing to play this Hawaiian-type music would require a guitar designed for such. What is needed is a device to convert a conventional guitar into an instrument suitable for playing Hawaiian-type music.

DETAILED DESCRIPTION

Figure 1:
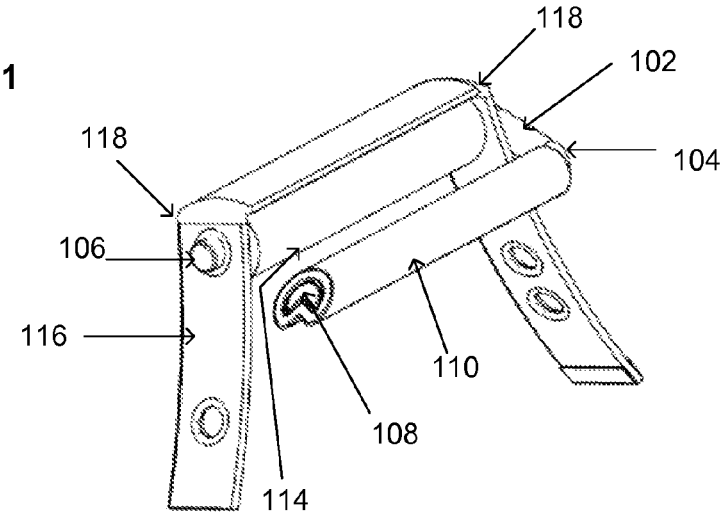
FIG. 1 and FIG. 1*a* are a perspective view of one embodiment of the present device.

FIG. 1 depicts a perspective view of one embodiment of the present device. In some embodiments, a substantially U-shaped member 102 can comprise a first extension 104 and a second extension 106, which can be substantially parallel to one another. In some embodiments, the first extension 104, and the second extension 106 can have substantially circular cross-sectional geometries. However, in alternate embodiments the first extension 104 and/or the second extension 106 can have any other known and/or convenient geometries. As shown in the embodiment in FIG. 1, a U-shaped member 102 can be substantially orthogonal relative to the first extension 104 and/or the second extension 106. However, in alternate embodiments the U-shaped member 102 can be rounded or any other known and/or convenient geometry and/or be in any known and/or desired relationship/configuration relative to either the first extension 104, the second extension 106 and/or both. In some embodiments, the U-shaped member 102 can be made of metal, plastic, polymer. However, in alternate embodiments the U-Shaped member 102 can be comprised of any other known and/or convenient material and/or materials.

In some embodiments, a first extension 104 can have a longitudinal groove 108 running substantially along the length of the first extension 104. In some embodiments, the longitudinal groove 108 can have a substantially V-shaped cross-sectional geometry, having a vertex point substantially coincident with the longitudinal axis of a first extension 104. In alternate embodiments, the longitudinal grove 108 can be parabolic in shape. However, in still further alternate embodiments, the longitudinal groove 108 can have any other known and/or convenient geometry adapted to selectively engage a fret on a guitar.

Figure 1A:
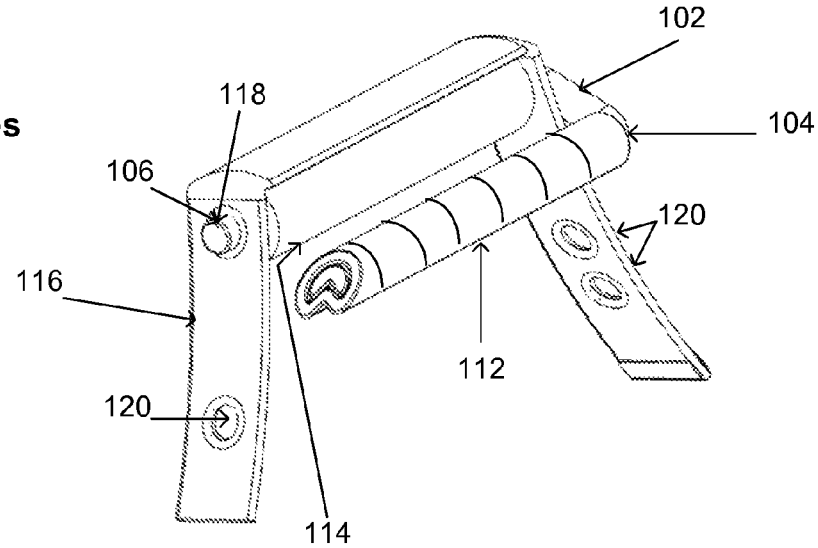

As shown in FIG. 1, a first extension 104 can have a covering 110. In some embodiments, a covering 110 can comprise a sleeve to surround the exterior surface of the first extension 104, but in other embodiments can have any other known and/or convenient configuration and/or the covering may partially cover the first extension 104 and/or can be absent. In some embodiments, the covering 110 can have substantially the same interior cross-sectional geometry as the cross-sectional geometry of a first extension 104, such that a longitudinal groove 108 can be maintained on the outer surface of a covering 110. As shown in FIG. 1, the covering 110 can have a substantially smooth surface, but in alternate the covering 110 embodiments can have any other known and/or convenient surface texture. However, in other embodiments, as shown in FIG. 1*a*, a covering 110 can comprise a plurality of circumferential grooves 112, configured to receive guitar strings. Circumferential grooves 112 can have a substantially V-shaped, orthogonal, semi-circular, or any other known and/or convenient cross-sectional geometry. In alternate embodiments the circumferential groves can have a semi-circular, parabolic and/or any other known, convenient and/or desired shape. In some embodiments, covering 110 can be made of rubber, plastic, polymer, or any other known and/or convenient material. In some embodiments, covering 110 can be interchangeable and/or selectively disengagable such that it can be exchanged for alternate coverings 110 of different wall thicknesses to establish selectively different distances above the frets of a guitar neck, depending upon the dimensions of the neck and the frets of a particular guitar.

As shown in FIG. 1, a second extension 106 can comprise a sleeve 114, which can be made of rubber, plastic, polymer, or any other known, desired and/or convenient material and/or materials. In some embodiments, the composition of the sleeve 114 can be a substantially resilient material. However, in alternate embodiments the composition can be have any known, convenient and/or desired properties. In some embodiments, sleeve 114 can have an interior cross-sectional geometry compatible with the exterior cross-sectional geometry of a second extension 106. In some embodiments, sleeve 114 can have a substantially circular cross-sectional geometry, but in other embodiments can have any other known, desired and/or convenient cross sectional geometry and/or geometries. As shown in FIG. 1, sleeve 114 can cover a second extension 106 such that the free end of the second extension 106 can be left uncovered.

In some embodiments, an elastic, flexible member 116 can extend parallel to the second extension 106. Additionally, in some embodiments, a flexible member 116 can have a pair of openings 118. As shown in FIG. 1, the pair of openings 118 can be spaced along the flexible member 116 such that the distance between openings 118 can be substantially congruent with the length of a second extension 106. As such, as shown in FIG. 1, one of a pair of openings 118 can receive the terminal end of a second extension 118, while the other opening 118 can receive the opposite end of a second extension 106. As shown in FIG. 1, in this embodiment, a flexible member 116 can be positioned proximal to a sleeve 114. A flexible member 116 can be further connected to a terminal end of a second extension 106 via a friction fit, adhesive, or any other known and/or convenient method and mechanism.

In some embodiments, as shown in FIG. 1, the free ends of flexible member 116 can be connected via adjustable connectors 120. In the embodiment depicted in FIG. 1, the connectors 120 can be snaps. However, in alternate embodiments, flexible member 116 can be connected by hook-and-loop fastener material, clips, and/or any other known, desired and/or convenient closure mechanism and/or method. In some embodiments, the closure mechanism can be permanent, semi-permanent and/or selectively engagable/disengagable.

Figure 2:
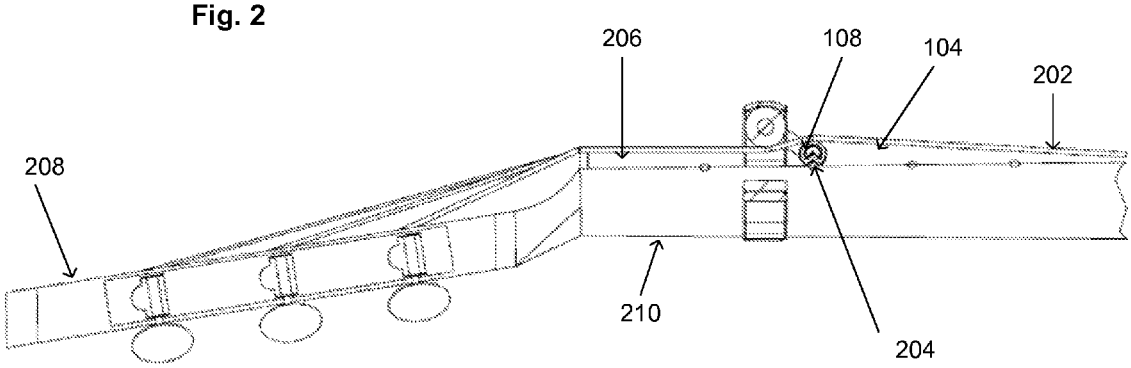
FIG. 2 is a transverse cross-sectional view of an embodiment of the present device in use on a conventional guitar.

In use, as shown in FIG. 2, an embodiment of the present device can be positioned substantially orthogonally across the neck of a guitar or other stringed instrument. A first extension 104 can be placed underneath the strings 202 and positioned such that the longitudinal groove 108 can selectively engage a desired fret 204. Strings 202 can be raised a desired height above a fretboard 206, depending on the diameter and/or thickness of a first extension 104 and/or the thickness of covering 110. A second extension 106 can be placed above the strings 202 and behind (i.e., toward the headstock 208). Additionally, the apparatus can be disengagably and/or fixedly engaged relative to the stringed instrument via the flexible member 116.

Figure 3:
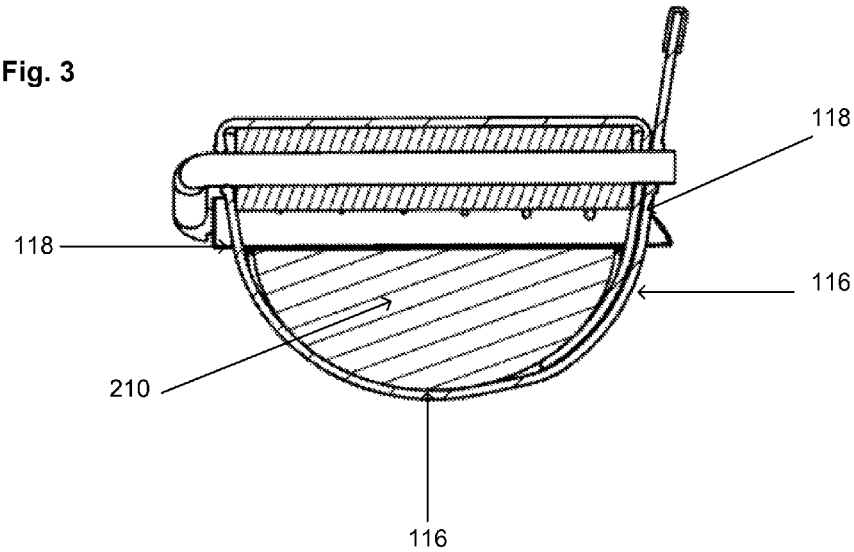
FIG. 3 is a longitudinal cross-sectional view of the embodiment of the present device shown in FIG. 2.

As shown in FIG. 3, a flexible member 116 can be wrapped around the neck 210 of a stringed instrument. The flexible member 116 can be stretched to create a tensile force within a flexible member 116. When wrapped around a neck 210 and selectively and/or fixedly secured in place, this can pull a second extension 106 toward a fretboard 206, allowing a second extension 106 to apply a compressive force holding strings 202 against a fretboard 206.

In some arrangements, the strings 202 can be raised sufficiently above the frets 204 on the neck 210 of a guitar to allow playing the instrument with a "steel" in the manner of a Hawaiian guitar. However, in alternate embodiments the strings 202 can be raised and/or lowered relative to the frets 204 and/or fret board 206 on the neck 210 to create any known, convenient and/or desired instrumental tone, pitch, timber, key and/or chord. By interchanging coverings 110, a user can change the desired height of the stings 202 above the frets 204. By positioning an embodiment of the present device at various fret 204 positions along a fret board 206, a user can also play in different keys.

Although the method has been described in conjunction with specific embodiments thereof, it is evident that many alternatives, modifications and variations will be apparent to those skilled in the art. Accordingly, the method as described and hereinafter claimed is intended to embrace all such alternatives, modifications and variations that fall within the spirit and broad scope of the appended claims.

What is claimed is:

1. A capo device for stringed instruments, comprising:

a substantially U-shaped member, having a first extension that is substantially parallel to a second extension, and wherein said first extension has a longitudinal groove substantially along its length, said longitudinal groove being configured to selectively receive a guitar fret;

a covering having an internal surface and an external surface and substantially the same internal cross-sectional geometry as the external surface of said first extension such that the internal surface of said covering is selectively mated with the exterior surface of said first extension;

a resilient sleeve substantially covering the outer longitudinal surface of said second extension;

an elastic, flexible member having two ends and aligned substantially parallel to and connected with said second extension such that said ends are free, wherein said free ends of said flexible member are removably connected by a fastener.

2. The device of claim 1, wherein said fastener is a snap system.

3. The device of claim 2, wherein said covering further comprises a plurality of circumferential grooves.

4. The device of claim 3, wherein said circumferential grooves are spaced at regular intervals along the length of said covering.

5. The device of claim 3, wherein said circumferential grooves are configured to selectively receive guitar strings.

6. The device of claim 2, wherein said covering is interchangeable.

7. A device for stringed instruments, comprising:

a support member;

a first elongated post coupled with said support member, wherein said first elongated post comprises an indentation configured to selectively receive a guitar fret, said indentation extending along the longitudinal length of said first elongated post;

a second elongated post having a first end and a second end, wherein said second elongated post is coupled with said support member such that said second elongated post is substantially parallel to said first elongated post;

a sheath configured to removably surround the longitudinal exterior of said first elongated post;

a first connection member coupled with said first end of said second elongated post;

a second connection member coupled with said second end of said second elongated post;

wherein said first connection member is removably coupled with said second connection member by a fastener.

8. The device of claim 7, wherein said sheath further comprises a sheath indentation along the longitudinal length of said sheath, wherein the interior of said sheath indentation is configured to fit into said indentation on said first elongated post.

9. The device of claim 8, wherein the exterior of said sheath indentation is configured to selectively receive a guitar fret.

10. The device of claim 7, wherein said first elongated post is configured to rest between the strings of a guitar and the neck of the guitar, and said second elongated post is configured to apply force to the top of the strings of the guitar when the first connection member is coupled with the second connection member underneath the neck of the guitar.

* * * * *

UNITED STATES PATENT AND TRADEMARK OFFICE

CERTIFICATE OF CORRECTION

PATENT NO. : 8,779,261 B2
APPLICATION NO. : 13/287976
DATED : July 15, 2014
INVENTOR(S) : Jim Dunlop et al.

It is certified that error appears in the above-identified patent and that said Letters Patent is hereby corrected as shown below:

Title Page, Item (12) delete "Dunlop" and insert --Dunlop et al.--.

Title Page, below Item (54) delete

"(75) Inventor: Jim Dunlop, Benicia, CA (US)"

and insert:

--(75) Inventors: Jim Dunlop, Benicia, CA (US); Kenneth M. Davidson, New Minas, CA (US)--.

Signed and Sealed this
Twenty-sixth Day of May, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,779,261 B2
APPLICATION NO. : 13/287976
DATED : July 15, 2014
INVENTOR(S) : Jim Dunlop et al.

It is certified that error appears in the above-identified patent and that said Letters Patent is hereby corrected as shown below:

Title Page, Item (12) delete "Dunlop" and insert --Dunlop et al.--.

Title Page, below Item (54) delete

"(75) Inventor: Jim Dunlop, Benicia, CA (US)"

and insert:

--(75) Inventors: Jim Dunlop, Benicia, CA (US); Kenneth M. Davidson, New Minas, NS (CA)--.

This certificate supersedes the Certificate of Correction issued May 26, 2015.

Signed and Sealed this
Fourth Day of August, 2015

Michelle K. Lee

Michelle K. Lee
*Director of the United States Patent and Trademark Office*